US011541275B2

(12) United States Patent
Motomura

(10) Patent No.: US 11,541,275 B2
(45) Date of Patent: Jan. 3, 2023

(54) EXERCISE APPARATUS

(71) Applicant: KENKO LIFE CORPORATION, Fukuoka (JP)

(72) Inventor: Shinsuke Motomura, Fukuoka (JP)

(73) Assignee: KENKO LIFE CORPORATION, Fukuoka (JP)

( * ) Notice: Subject to any disclaimer, the term of this patent is extended or adjusted under 35 U.S.C. 154(b) by 0 days.

(21) Appl. No.: 17/048,999

(22) PCT Filed: Apr. 16, 2019

(86) PCT No.: PCT/JP2019/016385
§ 371 (c)(1),
(2) Date: Oct. 19, 2020

(87) PCT Pub. No.: WO2019/203249
PCT Pub. Date: Oct. 24, 2019

(65) Prior Publication Data

US 2021/0197017 A1 Jul. 1, 2021

(30) Foreign Application Priority Data

Apr. 20, 2018 (JP) ..... JP2018-081268

(51) Int. Cl.
*A63B 22/16* (2006.01)
*A63B 21/00* (2006.01)
*A63B 71/00* (2006.01)

(52) U.S. Cl.
CPC ..... *A63B 22/16* (2013.01); *A63B 21/4034* (2015.10); *A63B 2071/0072* (2013.01)

(58) Field of Classification Search
CPC ..... A63B 22/16; A63B 21/4034; A63B 2071/0072; A63B 2209/00;
(Continued)

(56) References Cited

U.S. PATENT DOCUMENTS 3,416,792 A * 12/1968 Morgan ..... A63B 22/16 482/146
3,895,794 A * 7/1975 England ..... A63B 22/16 482/146
(Continued)

FOREIGN PATENT DOCUMENTS

CN 1850312 A 10/2006
CN 206081469 U 4/2017
(Continued)

*Primary Examiner* — Joshua Lee
*Assistant Examiner* — Catrina A Letterman
(74) *Attorney, Agent, or Firm* — Pearne & Gordon LLP

(57) ABSTRACT

[Problem to be Solved]
Provided is an exercise apparatus which can suppress positional displacement when a user is jiggling.
[Solution]
The exercise apparatus 1 includes: a main body part 5 which has a placement part (smooth surface 5*a*), on which both legs of a user are placed, and an arc part 5*b* (curved surface) and rotationally moves over a predetermined range by alternate movement of the legs of the user placed on the placement part; and restraining means which restrains movement of the main body part 5 within a horizontal plane. The restraining means has a groove part 5*c* which is formed by removing a portion of the arc part 5*b* of the main body part 5 and a columnar body 3 which is fitted into the groove part 5*c*.

6 Claims, 10 Drawing Sheets

(58) Field of Classification Search
CPC ... A63B 71/0054; A63B 4/00; A63B 22/0048; A63B 22/0056–0064; A63B 2022/0092; A63B 2022/0097; A63B 22/14; A63B 26/00–2026/006
See application file for complete search history.

(56) References Cited

U.S. PATENT DOCUMENTS 5,328,421 A * 7/1994 Stanalajczo ..... A63B 22/16 482/79
5,851,166 A * 12/1998 Bernardson ..... A63B 23/03533 482/79
5,897,474 A * 4/1999 Romero ..... A63B 22/14 482/79
8,496,538 B1 * 7/2013 Tyler ..... A63B 69/3652 473/279
11,097,153 B1 * 8/2021 Lee ..... A63B 22/18
2007/0298949 A1 12/2007 Soletski
2009/0197748 A1 * 8/2009 Smith ..... A63B 69/0093 482/146
2010/0167886 A1 * 7/2010 Ko ..... A63B 21/0552 482/123
2011/0098164 A1 * 4/2011 Chang ..... A63B 4/00 482/146
2011/0263398 A1 * 10/2011 Klassen ..... A63B 22/18 482/146
2013/0029815 A1 * 1/2013 Lu ..... A63B 23/03508 482/142
2013/0288866 A1 * 10/2013 Rainey ..... A63B 22/18 482/146
2014/0051553 A1 * 2/2014 Hetzel ..... A63B 21/0442 482/52
2014/0087927 A1 * 3/2014 Richard ..... A63B 23/03541 482/123
2014/0162859 A1 * 6/2014 Cheng ..... A63B 26/003 482/142
2016/0325135 A1 11/2016 Franche
2017/0095694 A1 * 4/2017 Polinsky ..... A63F 13/211
2018/0117389 A1 * 5/2018 Kao ..... A63B 71/023
2019/0091510 A1 * 3/2019 Wallace ..... A63B 26/003
2019/0314664 A1 * 10/2019 Jacobson ..... A63B 21/00181
2020/0238135 A1 * 7/2020 Stehlik ..... A63B 22/18

FOREIGN PATENT DOCUMENTS

JP H06105930 A 4/1994
JP 2002291942 A 10/2002
JP 2011529352 A 12/2011
JP 2016073597 A 5/2016
JP 2016101193 A 6/2016

* cited by examiner (a)

(b)

EXERCISE APPARATUS

TECHNICAL FIELD

The present invention relates to an exercise apparatus for exercise in which a user alternately moves both of his or her legs up and down.

BACKGROUND ART

It has been said that as simplified means for promoting blood circulation, relieving stress, and eliminating a lack of exercise, exercise or motion in which both legs are alternately jiggled up and down, that is, the so-called "jittering" is effective (hereinafter, this motion is referred to as "jiggling"). In recent years, the jiggling has been attracting attention as means for eliminating a lack of exercise of the elderly who is forced to use a wheelchair.

Therefore, conventionally, a foot stepping device which allows the jiggling to be easily performed in a posture in which a user is seated on a wheelchair or the like has been proposed (for example, Patent Literature 1). The foot stepping device shown in Patent Literature 1 has a shape obtained by cutting a circular cylinder from a direction orthogonal to a smooth surface, and the smooth surface serves as a footrest part. A user brings a vertex portion of an arc thereof into contact with a floor or the like, places both legs on the footrest part in this state, and then, alternately moves the legs up and down. Thus, the user can continuously perform the jiggling.

CITATION LIST

Patent Literature

[Patent Literature 1]
Japanese Patent Application Laid-Open Publication No. 2016-73597

SUMMARY OF INVENTION

Technical Problem

However, in the above-mentioned conventional technology, upon pressing down one side of the foot stepping device by a foot of the user, the foot stepping device shifts to an unexpected direction from a predetermined position by a force exerted upon pressing down (positional displacement within a horizontal plane), thereby causing the situation in which the jiggling cannot be continuously and smoothly performed in a fixed position. As described above, in the conventional technology, it is difficult to continuously perform the jiggling while the positional displacement is suppressed.

Therefore, an object of the present invention is to provide an exercise apparatus which allows the jiggling to be continuously performed while the positional displacement is suppressed.

Solution to Problem

An exercise apparatus of the present invention includes: a placement part on which both legs of a user are placed; a main body part which has an arc part and rotationally moves over a predetermined range by alternate movement of the legs of the user placed on the placement part; and restraining means which restrains movement of the main body part within a horizontal plane, the restraining means having a recessed part formed by removing a portion of the arc part of the main body part and a projection part fitted into the recessed part.

Advantageous Effect of Invention

According to the present invention, jiggling can be continuously performed while positional displacement is suppressed.

DESCRIPTION OF EMBODIMENTS

Embodiment 1

Figure 1:
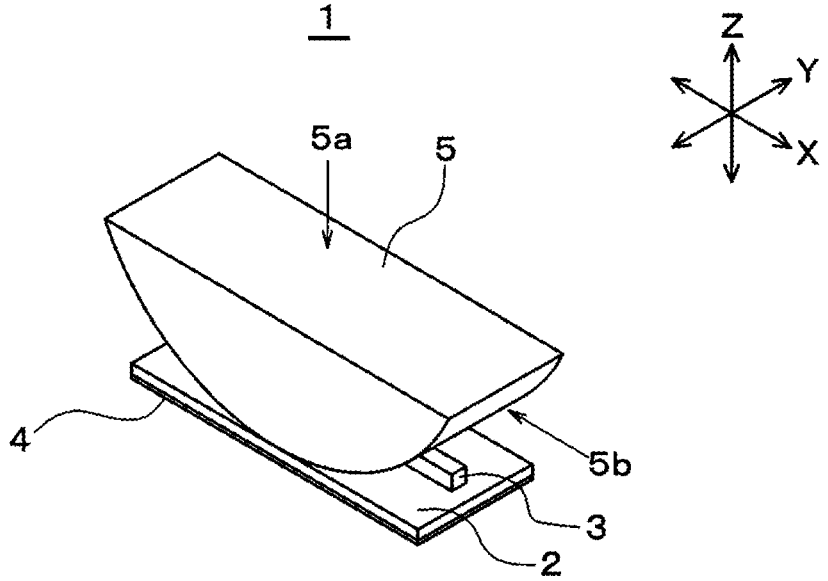
FIG. 1 shows schematic perspective views (a) and (b) of a whole exercise apparatus according to Embodiment 1 of the present invention.
Figure 1:
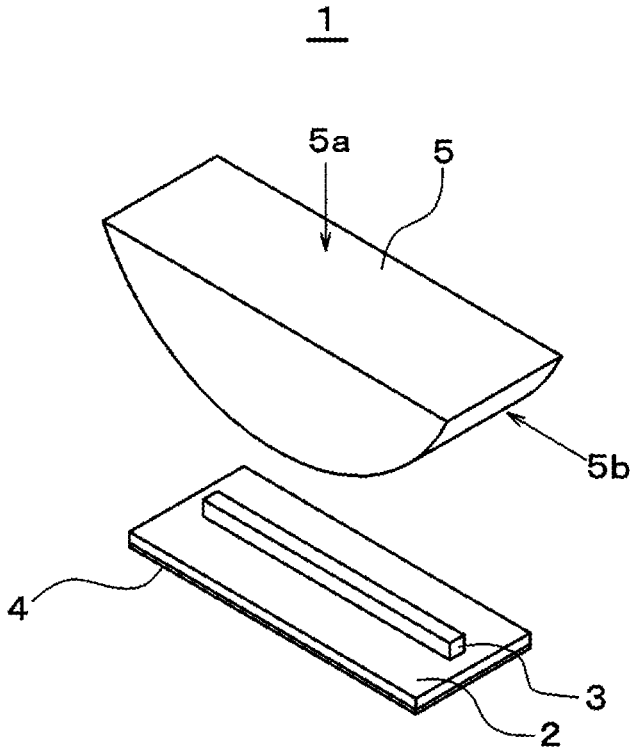
Figure 2:
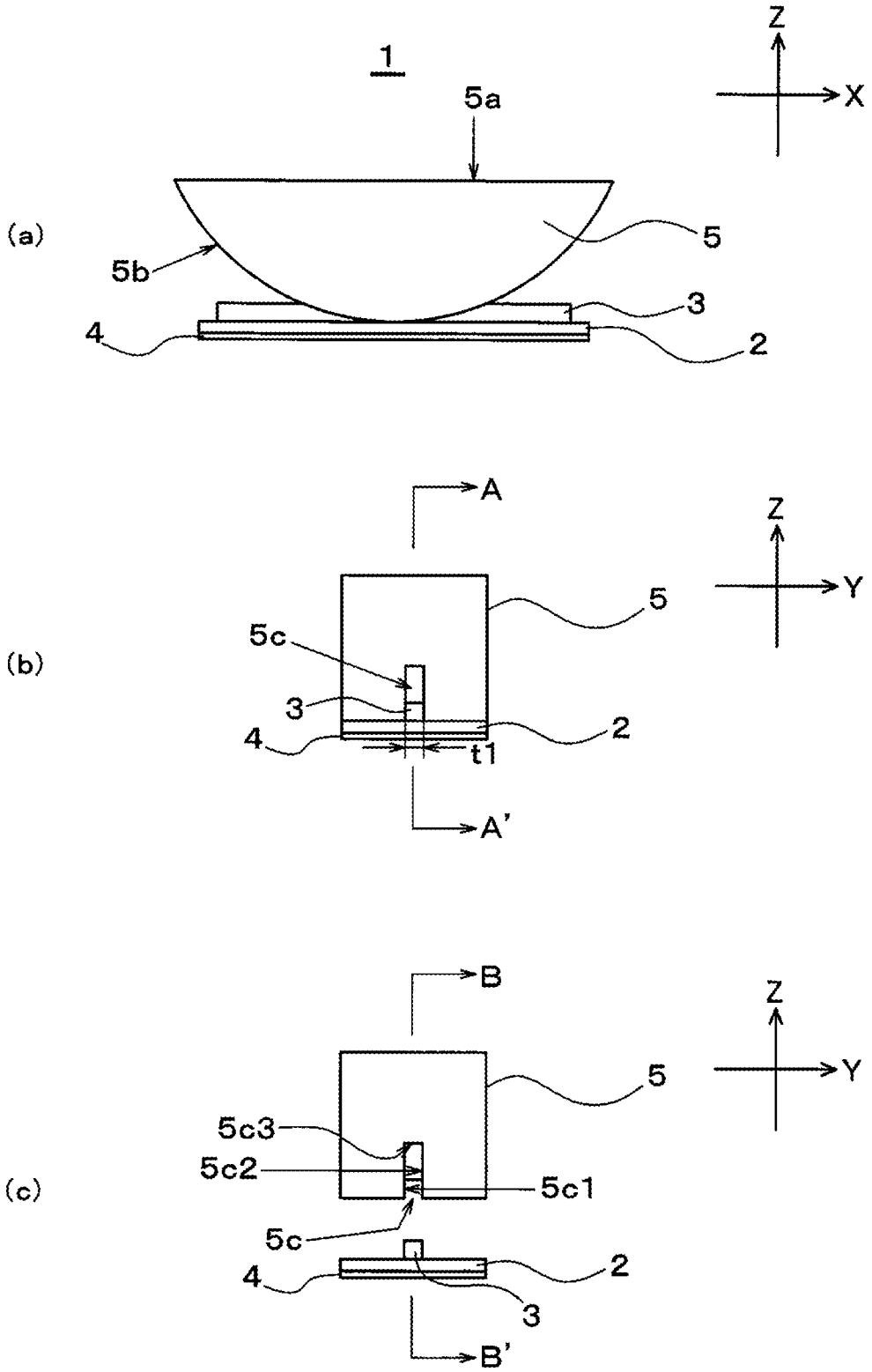
FIG. 2 shows a schematic front view (a) and schematic side views (b) and (c) of the exercise apparatus according to Embodiment 1 of the present invention.
Figure 3:
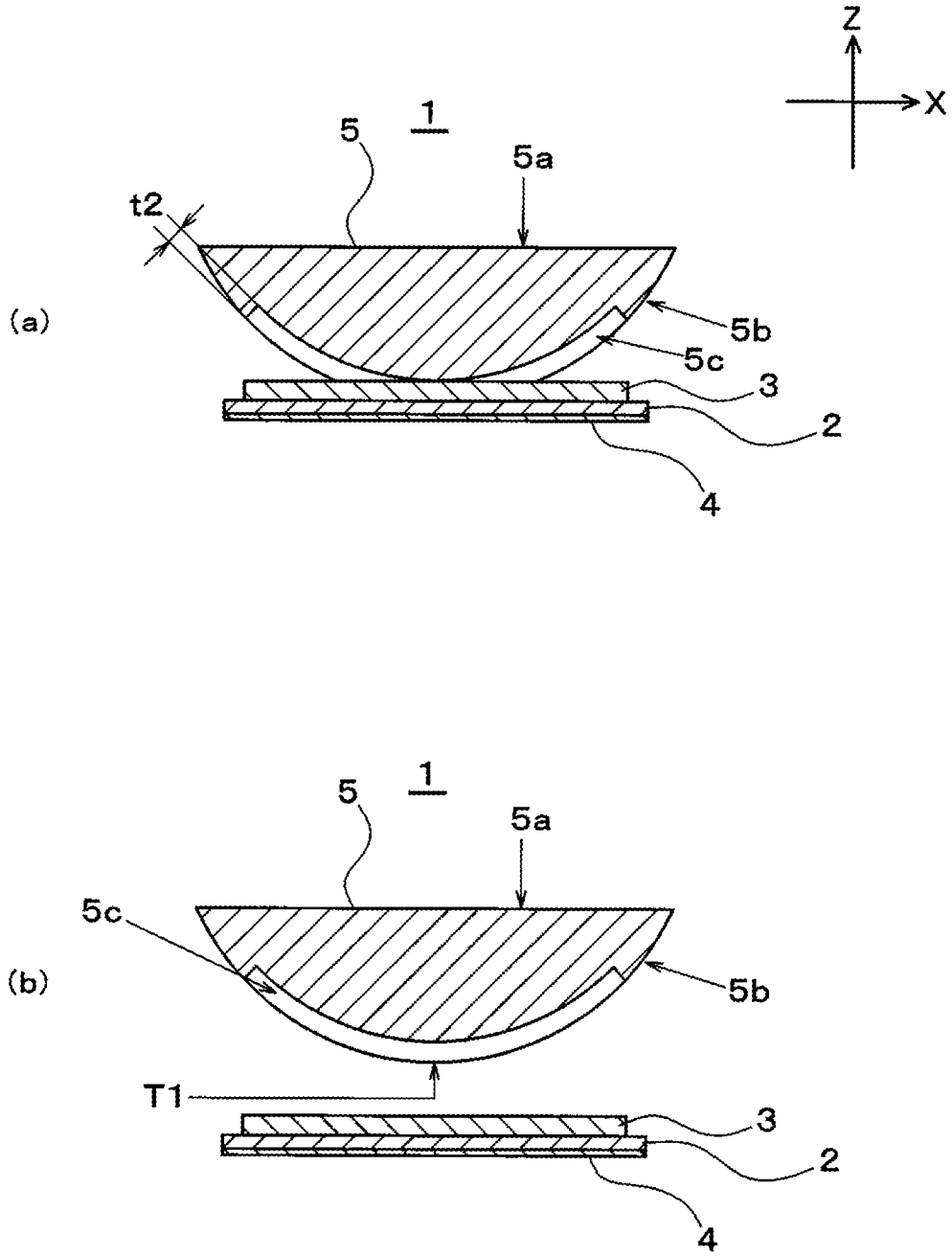
FIG. 3 shows schematic views (a) and (b) of the exercise apparatus, viewed along arrows A-A' and arrows B-B' shown in FIG. 2 (b) and (c), respectively, according to Embodiment 1 of the present invention.

With reference to FIGS. 1 to 5, an exercise apparatus according to Embodiment 1 of the present invention will be described. FIGS. 3 (a) and (b) show views of the exercise apparatus, viewed along arrows A-A' and arrows B-B' shown in FIGS. 2 (b) and (c), respectively. The exercise apparatus 1 is used for exercise or motion in which both legs of a user are alternately jiggled up and down from his or her heel sides, that is, exercise (jiggling) of both legs of the user.

Figure 6:
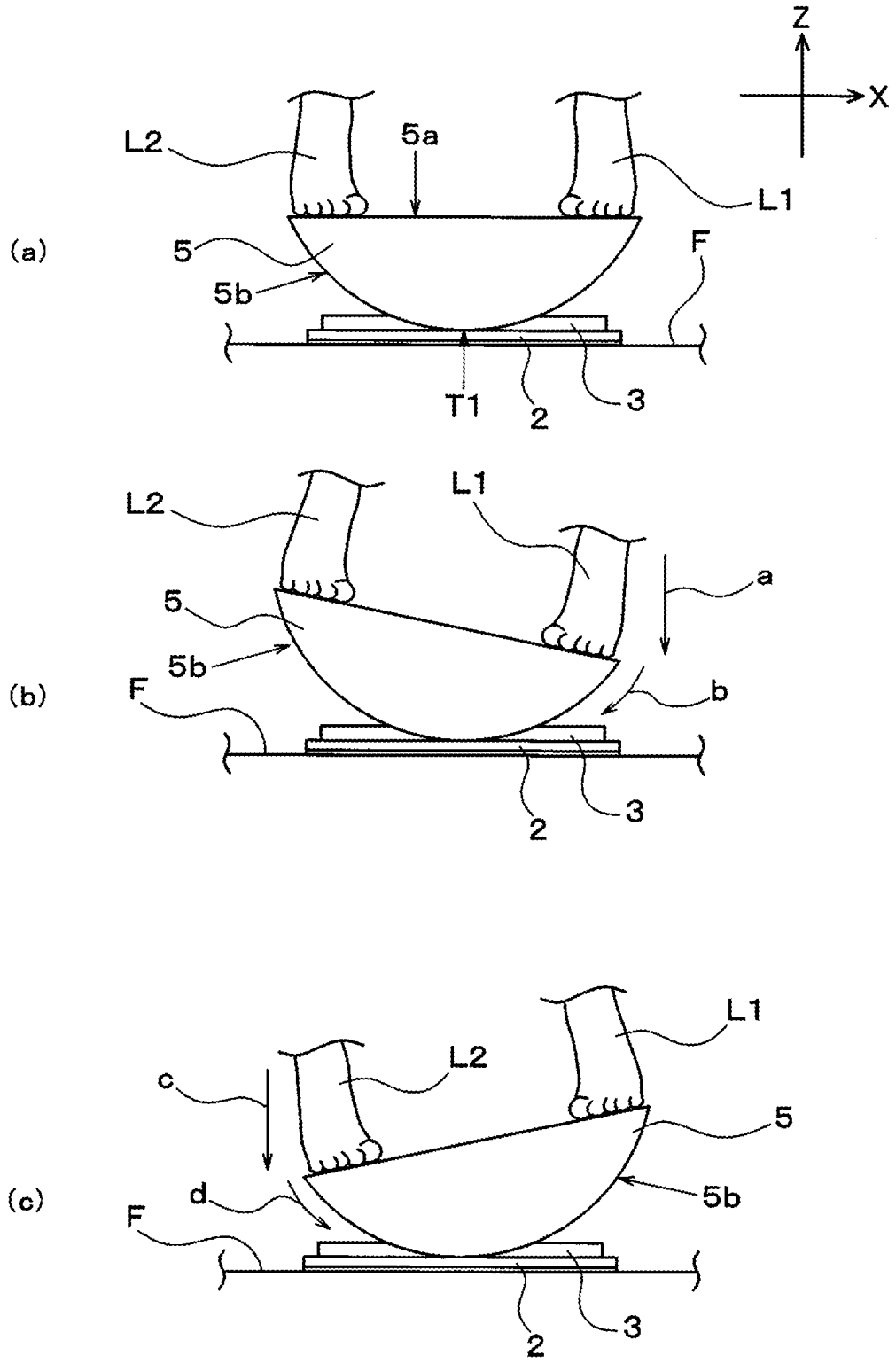
FIG. 6 shows diagrams (a), (b), and (c) illustrating a usage example of the exercise apparatus according to Embodiment 1 of the present invention.

The exercise apparatus 1 includes a rectangular base part 2 which is placed on a floor surface F (FIG. 6). On an upper surface of the base part 2, a columnar body 3 as a projection part, which extends in a longitudinal direction of the base part 2, is fixed. In other words, the base part 2 supports the columnar body 3 from below. On a lower surface of the base part 2, a rubber sheet 4 as an anti-skidding member is provided, and thus, the base part 2 does not skid with respect to the floor surface F. Hereinafter, a direction in parallel with a long side of the base part 2 is defined as an X-axis direction, a direction orthogonal to the X-axis direction within a horizontal plane is defined as a Y-axis direction, and a direction orthogonal to an X-Y plane is defined as a Z-axis direction.

The base part 2 is provided with a main body part 5 as a rotationally moving body in such a way as to be rotationally movable over a predetermined range with respect to the base part 2. The main body part 5 is formed in an arc shape (semicircular shape) in a front view by cutting, for example, a circular cylinder-shaped member from a direction orthogonal to a smooth surface. Thus, a cut surface of the main body part 5 becomes a smooth surface 5*a*, and an arc part 5*b* is formed along a circumferential direction excluding the smooth surface 5*a* of the main body part 5. In other words, the arc part 5*b* has a curved surface. The base part 2, the columnar body 3, and the main body part 5 are formed of, for example, wood.

In FIGS. 2 (b) and (c) and FIGS. 3 (a) and (b), the main body part 5 has a groove part 5*c* as a recessed part formed over a predetermined range by partially removing a portion of the arc part 5*b* (curved surface). In Embodiment 1, by partially removing the portion of the arc part 5*b* (curved surface) along the circumferential direction with an apex T1 (FIG. 3 (b)) as a point of origin, the groove part 5*c* is formed. It is preferable that a range in which the groove part 5*c* is formed forms an obtuse angle. In FIG. 2 (c), surfaces 5*c*1, 5*c*2, and 5*c*3 of the main body part 5, on which the groove part 5*c* is formed are, for example, "rough" by rough surface machining.

As shown in FIG. 2 (b), a length dimension t1 of the groove part 5*c* in a width direction is set to be substantially the same as a length dimension of the columnar body 3 in a width direction or to be slightly larger than the length dimension of the columnar body 3. As shown in FIG. 3 (a), a depth t2 of the groove part 5*c* is set to be substantially the same as a height of the columnar body 3 (a length dimension thereof in the Z-axis direction). By fitting the columnar body 3 into the groove part 5*c*, the main body part 5 is rotatably supported to the base part 2 and the columnar body 3 with a horizontal direction as an axial center.

Figure 4:
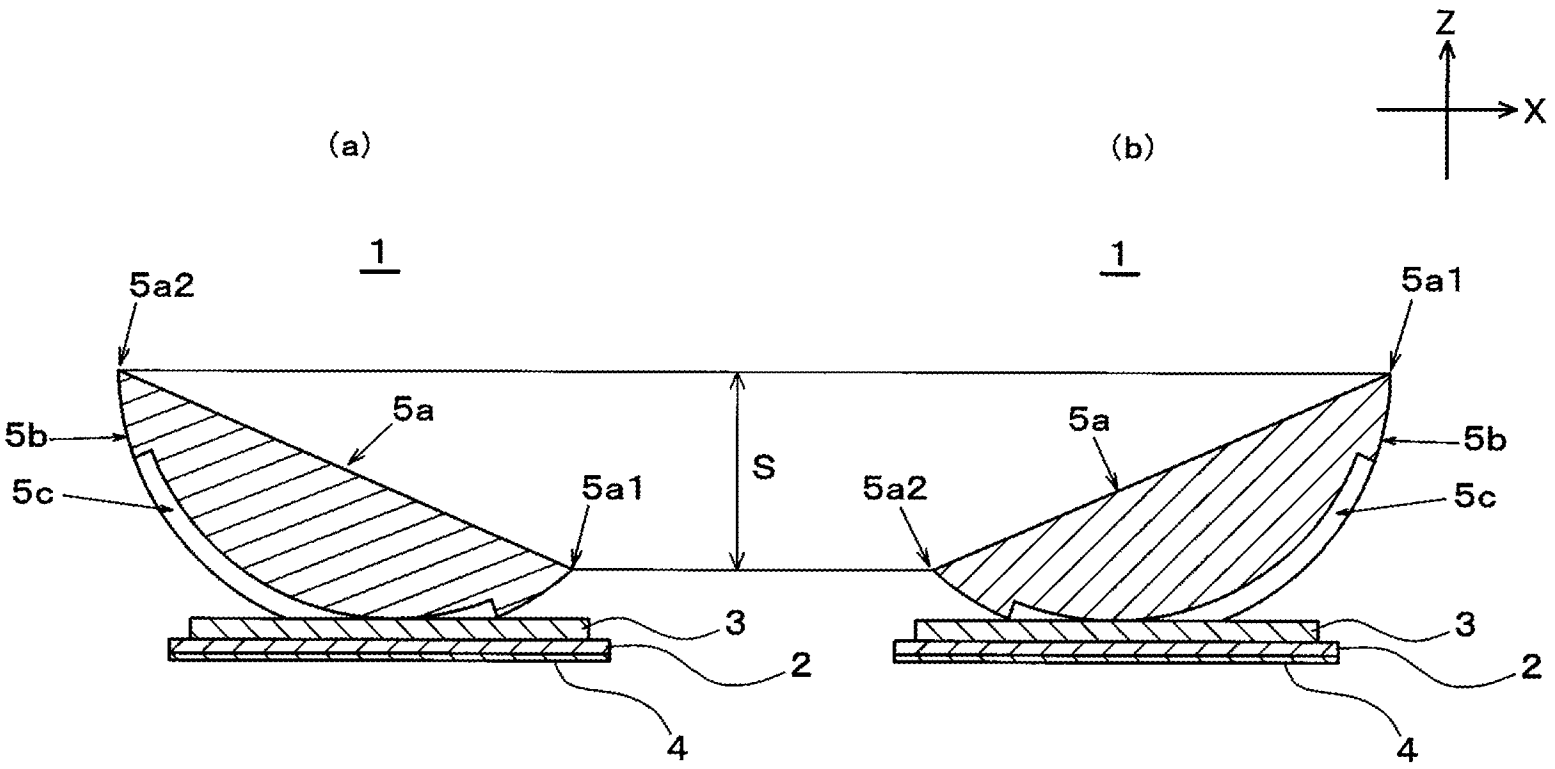
FIG. 4 shows schematic explanatory diagrams (a) and (b) of a structure of the exercise apparatus according to Embodiment 1 of the present invention.

The main body part 5 rotationally moves along the arc part 5*b* (curved surface) with respect to the base part 2 and the columnar body 3 within the range in which the groove part 5*c* is formed. Accordingly, as shown in FIGS. 4 (a) and (b), one end portion Sal of the smooth surface 5*a* of the main body part 5 moves in the Z-axis direction over a predetermined distance S by jiggling of a user. In Embodiment 1, since height positions of both end portions of the groove part 5*c* are the same as each other, the other end portion 5*a*2 of the smooth surface 5*a* of the main body part 5 also moves over the predetermined distance S.

Figure 5:
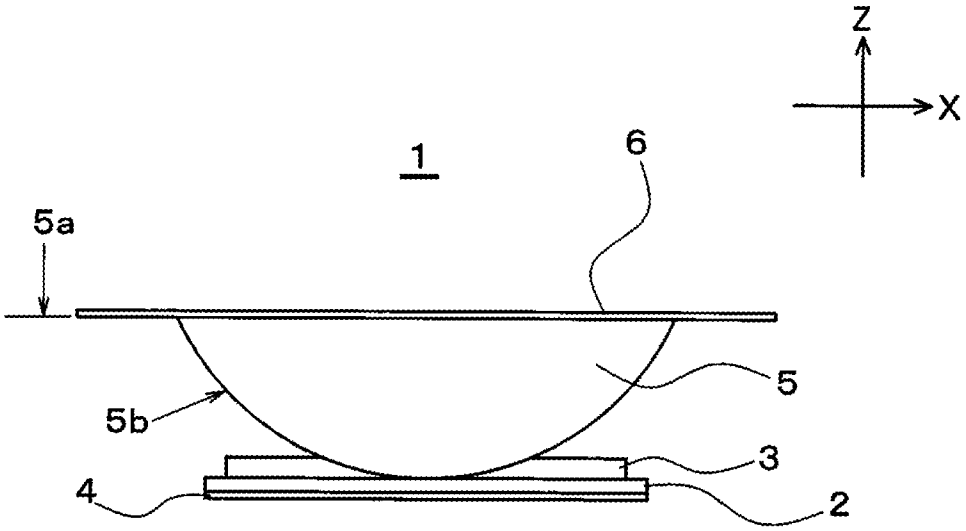
FIG. 5 shows a schematic front view of the exercise apparatus according to Embodiment 1 of the present invention.

The smooth surface 5*a* of the main body part 5 serves as a placement part on which both legs L1 and L2 (FIG. 6) of the user are placed. Note that as shown in FIG. 5, in accordance with a physical characteristic of the user (for example, a body height), a plate member 6 which has a length dimension larger than a length dimension of the smooth surface 5*a* in a longitudinal direction is fixed on the smooth surface 5*a*, and this plate member 6 may be the placement part. In addition, in positions on the smooth surface 5*a* which both legs L1 and L2 of the user contact or in positions on the plate member 6, anti-skidding members such as rubber sheets may be provided.

The exercise apparatus 1 according to Embodiment 1 is configured as described above. Next, with reference to FIG. 6, a usage example of the exercise apparatus 1 will be described. First, as shown in FIG. 6 (a), a user sets the exercise apparatus 1 on the floor surface F. Note that a basic posture of the exercise apparatus 1 prior to starting the jiggling is in a position where the apex T1 of the arc part 5*b* of the main body part 5 is closest to the base part 2, that is, a position where the smooth surface 5*a* becomes horizontal.

Subsequently, the user places respective one leg L1 and the other leg L2 on both sides of the smooth surface 5*a*. Subsequently, as shown in FIG. 6 (b), the user moves the one leg L1 from a heel side downward (as indicated by an arrow a), whereby the main body part 5 rotationally moves in an arrow b direction while fitting of the groove part 5*c* and the columnar body 3 is maintained, and the other leg L2 moves upward. In other words, the main body part 5 is not disengaged from the columnar body 3, and movement (positional displacement) in a width direction (Y-axis direction orthogonal to a longitudinal direction of the columnar body 3 within the horizontal plane) is restrained by the columnar body 3. Note that since the surfaces 5*c*1, 5*c*2, and 5*c*3 of the main body part 5, which form the groove part 5*c*, are "rough" and upon jiggling, the surfaces 5*c*1, 5*c*2, and 5*c*3 of the main body part 5 slide on a surface of the columnar body 3, skidding of the main body part 5 in the longitudinal direction of the columnar body 3 (X-axis direction) is also suppressed.

Subsequently, as shown in FIG. 6 (c), the user moves the other leg L2 from a heel side downward (as indicated by an arrow c), whereby the main body part 5 rotationally moves in an arrow d direction while the fitting of the groove part 5*c* and the columnar body 3 is maintained, and the one leg L1 moves upward. The user alternately jiggles the one leg L1 and the other leg L2 up and down (jiggling), whereby the main body part 5 rotationally moves in a reciprocated manner (the arrow b →the arrow d →the arrow b →the arrow d . . . ).

As described above, the main body part 5 has the arc part 5*b* (curved surface) and both legs L1 and L2 of the user placed on the placement part alternately move, whereby the main body part 5 rotationally moves over the predetermined range along a circumferential direction of the arc part 5*b*. In addition, the groove part 5*c* formed on the base part 2, on the columnar body 3, and in the main body part 5 serves as restraining means which restrains the movement of the main body part 5 within the horizontal plane. In addition, the groove part (recessed part) 5*c* is formed along the arc part 5*b* (curved surface) of the main body part 5, and the columnar body (projection part) 3 is installed on the floor surface F via the base part 2, extends in one direction, and is fitted into the groove part 5*c*. Furthermore, the base part 2 is installed on the floor surface F and fixes the columnar body 3 on the upper surface thereof.

As described above, the exercise apparatus 1 according to Embodiment 1 can suppress the positional displacement of the main body part 5 when the user performs the jiggling, and as a result, the jiggling can be continuously performed in the fixed position.

Embodiment 2

Figure 7:
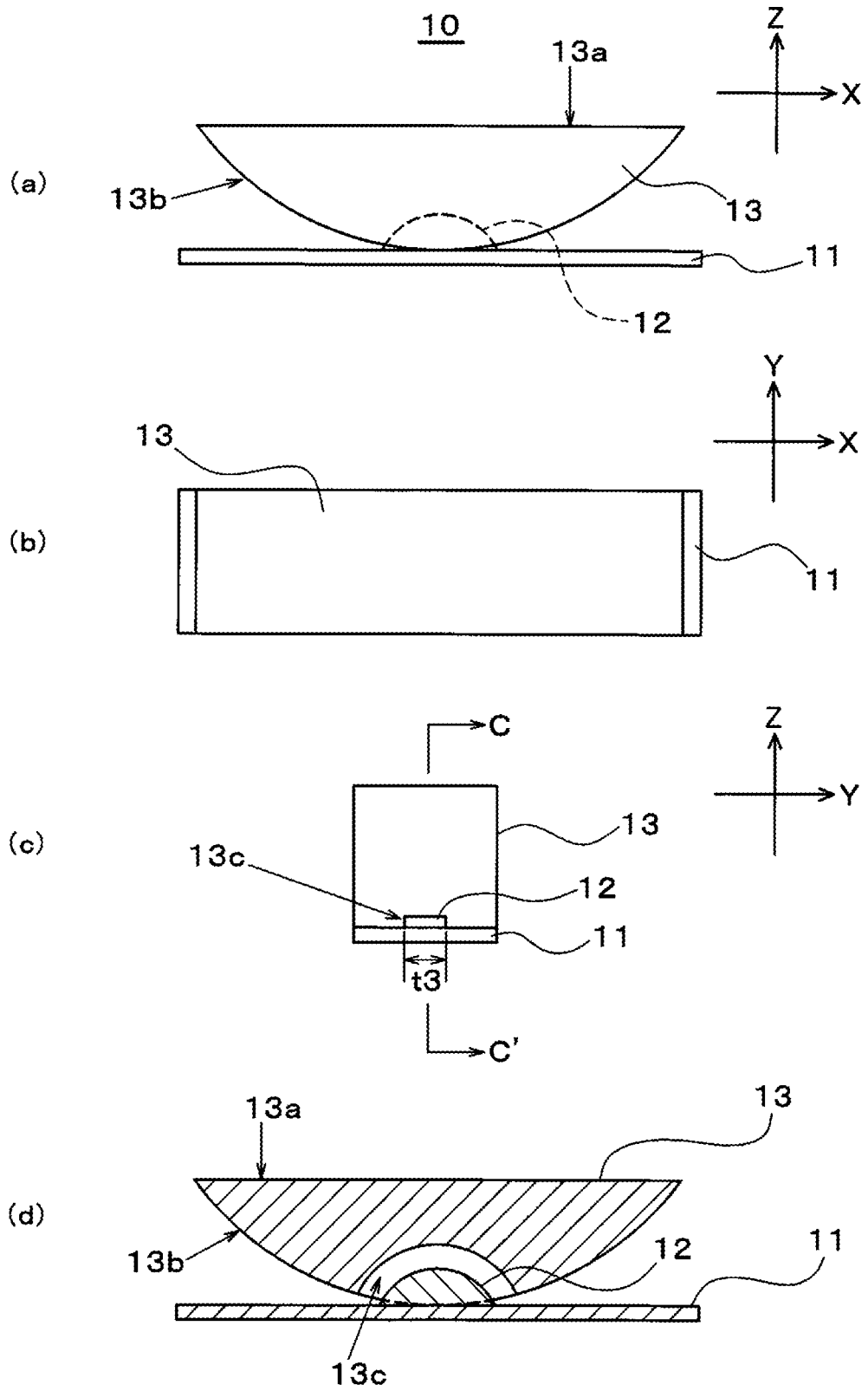
FIG. 7 shows a schematic front view (a), a schematic plan view (b), a schematic side view (c), and a schematic view (d) viewed along arrows C-C' shown in FIG. 7 (c) of an exercise apparatus according to Embodiment 2 of the present invention.
Figure 8:
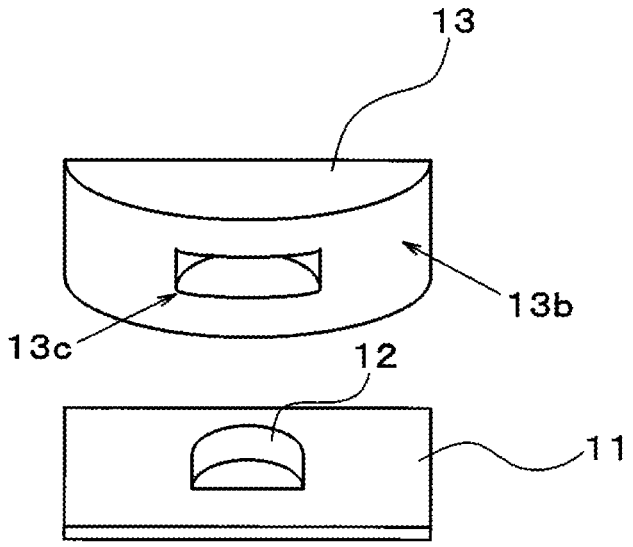
FIG. 8 shows a schematic explanatory diagram of the exercise apparatus according to Embodiment 2 of the present invention.

Next, with reference to FIGS. 7, 8, and 9, an exercise apparatus according to Embodiment 2 of the present invention will be described. Shapes of a recessed part and a projection part in the exercise apparatus 10 according to Embodiment 2 are different from the shapes of the recessed part and the projection part in the exercise apparatus 1 according to Embodiment 1. In other words, on an upper surface of a base part 11 which the exercise apparatus 10 includes, by cutting a portion of a circular cylinder-shaped member from a direction orthogonal to a smooth surface, a raised part 12 as a projection part which is formed in a manner of arcing from both sides toward a central portion thereof and of being raised is provided. In other words, the raised part 12 has a curved surface and is formed in a substantially semicircular shape in a front view.

A main shape of a main body part 13 is similar to that of the main body part 5 according to Embodiment 1, and on an upper surface thereof, a smooth surface 13*a* as a placement part is formed. In the main body part 13, in a substantially central portion thereof with an apex T2 (FIG. 9) as a center, by partially removing a portion of an arc part 13*b* (curved surface) in an arcing (circular-arcing) manner, a groove part 13*c* as a recessed part which is formed in a substantially semicircular shape in a front view is formed. As shown in FIG. 7 (c), a length dimension t3 of the groove part 13*c* in a width direction is substantially the same as a length dimension of the raised part 12 in a width direction or is slightly larger than the length dimension of the raised part 12 in a width direction. Accordingly, in a state in which the main body part 13 is fitted to the raised part 12 via the groove part 13*c*, movement of the main body part 13 in a width direction (Y-axis direction) is restrained.

Figure 9:
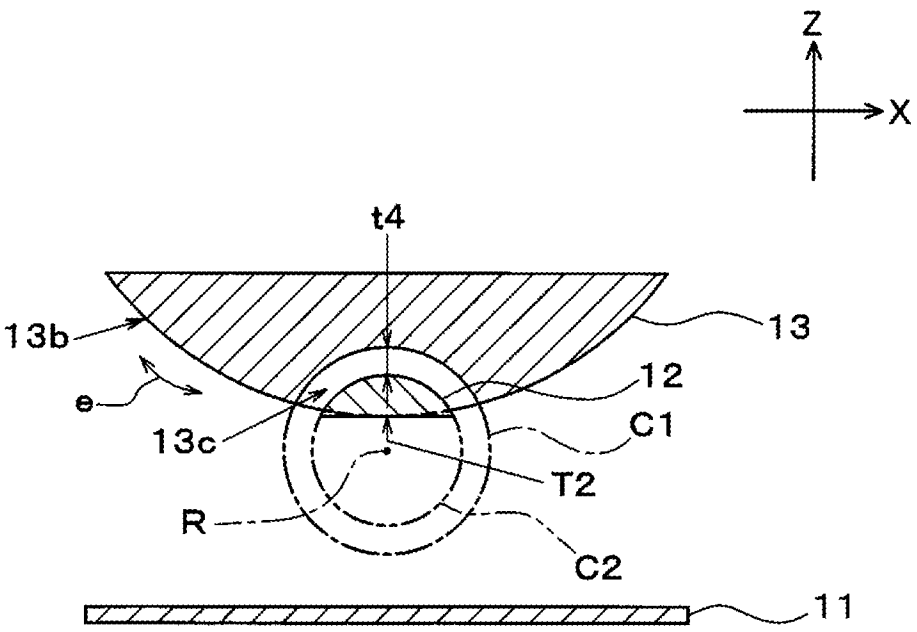
FIG. 9 shows a schematic explanatory diagram of a structure of the exercise apparatus according to Embodiment 2 of the present invention.

In FIG. 9, a diameter of a virtual circle C1 which is formed along an edge portion of the groove part 13*c* is set to be larger than a diameter of a virtual circle C2 which is formed along an edge portion of the raised part 12. In addition, when the main body part 13 is fitted to the raised part 12 in such a way as to make a position of the apex T2 closest to the base part 11, the virtual circles C1 and C2 are concentrically located with a center point R as a center. Accordingly, between the edge portion forming the groove part 13*c* and the raised part 12, a clearance (play allowance) having a fixed width t4 is brought about. In the state in which the main body part 13 is fitted to the raised part 12 via the groove part 13*c*, movement of the main body part 13 to a direction within a horizontal plane is permitted in a range in accordance with the above-mentioned clearance, and the main body part 13 can rotationally move with respect to the base part 11 and the raised part 12 (as indicated by an arrow e). In FIG. 9, for the sake of convenience, the main body part 13 and the base part 11 are illustrated in such a way as to be separated from each other.

Figure 10:
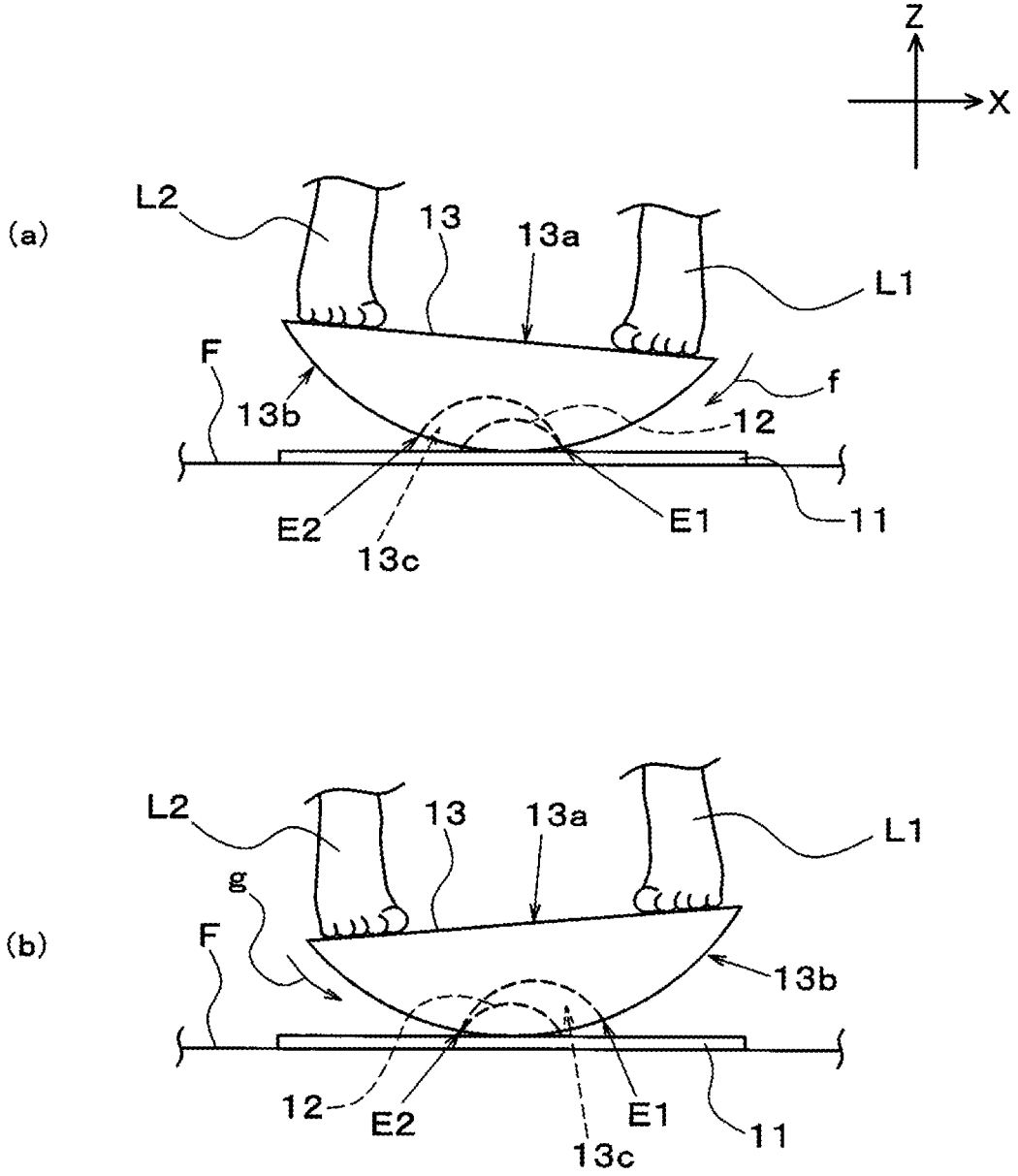
FIG. 10 shows diagrams (a) and (b) illustrating a usage example of the exercise apparatus according to Embodiment 2 of the present invention.

As shown in FIGS. 10 (a) and (b), in a state in which a user places both of his or her legs L1 and L2 on the smooth surface 13*a* of the main body part 13, the user jiggles both of his or her legs L1 and L2 up and down, whereby the main body part 13 rotationally moves in the range in accordance with the clearance while the arc part 13*b* (curved surface) is brought into contact with the base part 11 (an arrow f →an arrow g →the arrow f →the arrow g . . . ). Upon the rotational movement of the main body part 13, the raised part 12 contacts respectively edge parts E1 and E2 of the groove part 13*c*, whereby movement of the main body part 13 in a longitudinal direction (X-axis direction) is restrained. In other words, the exercise apparatus 10 according to Embodiment 2 can restrain the movement of the main body part 13 in the X and Y directions upon jiggling.

The design of the exercise apparatus according to the present invention can be changed without departing from the scope of the invention. For example, the shape of the columnar body 3 may be any shape, and it is only required for the shape of the columnar body 3 to be capable of fitting to the groove part 5*c* and to be a projecting shape which extends in one direction with respect to the base part 2. In addition, on the upper surface of the main body part 5, recessed parts having sizes which allow feet to be housed may be provided, and with the feet housed in these recessed parts, the jiggling may be performed. In addition, on a surface of the placement part (smooth surface 5*a*) which the main body part 5 has, recesses and projections may be present. Furthermore, in the exercise apparatus 10 according to Embodiment 2, the main body part 13 may be provided with a plurality of groove parts 13*c*, and the base part 11 may be provided with raised parts 12 whose number corresponds to the number of the groove parts 13*c*.

INDUSTRIAL APPLICABILITY

According to the present invention, jiggling can be continuously performed while positional displacement is suppressed, and in particular, the present invention is useful as a tool for eliminating a lack of exercise of the elderly.

REFERENCE SIGNS LIST

1, 10 Exercise apparatus
2, 11 Base part
3 Columnar body (Projection part)
5, 13 Main body part
5*a*, 13*a* Smooth surface (Placement part)
5*b*, 13*b* Arc part
5*c*, 13*c* Groove part (Recessed part)
12 Raised part (Projection part)
F Floor surface

The invention claimed is:

1. An exercise apparatus comprising:
a placement part on which legs of a user are placed;
a main body part which rotationally moves over a predetermined range by alternate movement of the legs of the user placed on the placement part; and
restraining means which prevents movement of the main body part in a direction orthogonal to a rotational direction of the main body part, and restrains movement of the main body part in the rotational direction, wherein
the restraining means having
a recessed part formed in the main body part,
a projection part fitted into the recessed part, and
a base part comprising an upper plane surface and the projection part being fixed to the base part,
the main body part is rotatably supported with respect to the base part and the projection part,
the main body part comprises the placement part, a lowermost arc surface, and the recessed part, and
a portion of the lowermost arc surface is in direct contact with a portion of the upper plane surface of the base part.

2. The exercise apparatus according to claim 1, wherein the base part is to be placed on a floor surface, the projection part being fixed on the upper plane surface of the base part.

3. The exercise apparatus according to claim 1, wherein, when the main body part is in a rotational movement, the movement of the main body part in the rotational direction is restrained by the projection part contacting an edge of the recessed part.

4. The exercise apparatus according to claim 3, wherein the base part is to be placed on a floor surface, the projection part being fixed on an upper surface of the base part.

5. The exercise apparatus according to claim 1, wherein the portion of the lowermost arc surface that is in direct contact with the portion of the upper plane surface of the base part moves according to the rotational movement of the main body.

6. An exercise apparatus comprising:

a main body which includes an upper surface, a lowermost arc surface, and a recession, the main body rotationally moving over a predetermined range by alternate movement of legs of a user placed on the upper surface, and a base which includes an upper plane surface and a projection that engages with the recession, wherein the lowermost arc surface of the main body is in direct contact with the upper plane surface of the base and the lowermost arc surface rotates on the upper plane surface of the base so that the main body rotationally moves on the base, and wherein the recession and the projection prevent movement of the main body in a direction orthogonal to a rotational direction of the main body, and restrain movement of the main body in the rotational direction.

* * * * *